United States Patent [19]

Wenger

[11] 4,089,158

[45] May 16, 1978

[54] FLUID-TIGHT WINDING BUTTON ASSEMBLY

[75] Inventor: Karl Wenger, Chambesy, Switzerland

[73] Assignee: Boninchi S.A., Switzerland

[21] Appl. No.: 764,993

[22] Filed: Feb. 2, 1977

[30] Foreign Application Priority Data

Mar. 23, 1976 Switzerland ..... 3602/76

[51] Int. Cl.[2] ..... G04B 3/00; G04B 37/10

[52] U.S. Cl. ..... 58/73; 58/90 B; 58/95 R; 58/98; 58/99

[58] Field of Search ..... 58/63, 67, 73, 80, 90 B, 58/95 R, 98, 99

[56] References Cited

FOREIGN PATENT DOCUMENTS 1,491,824 8/1967 France ..... 58/90 B

*Primary Examiner*—Stanley J. Witkowski

*Attorney, Agent, or Firm*—Robert E. Burns; Emmanuel J. Lobato; Bruce L. Adams

[57] ABSTRACT

A winding button has an internally threaded skirt into which a sleeve is fully screwed leaving part of the thread for screwing the button on a pendant tube. When the button is unscrewed, a spring acting between a winding-stem shank and the sleeve biases the sleeve and button to an outer position in which the shank is coupled for rotation with the sleeve. Sealing joints are placed between the sleeve and the button and the sleeve and the pendant tube.

1 Claim, 2 Drawing Figures

FLUID-TIGHT WINDING BUTTON ASSEMBLY

Figure 2:
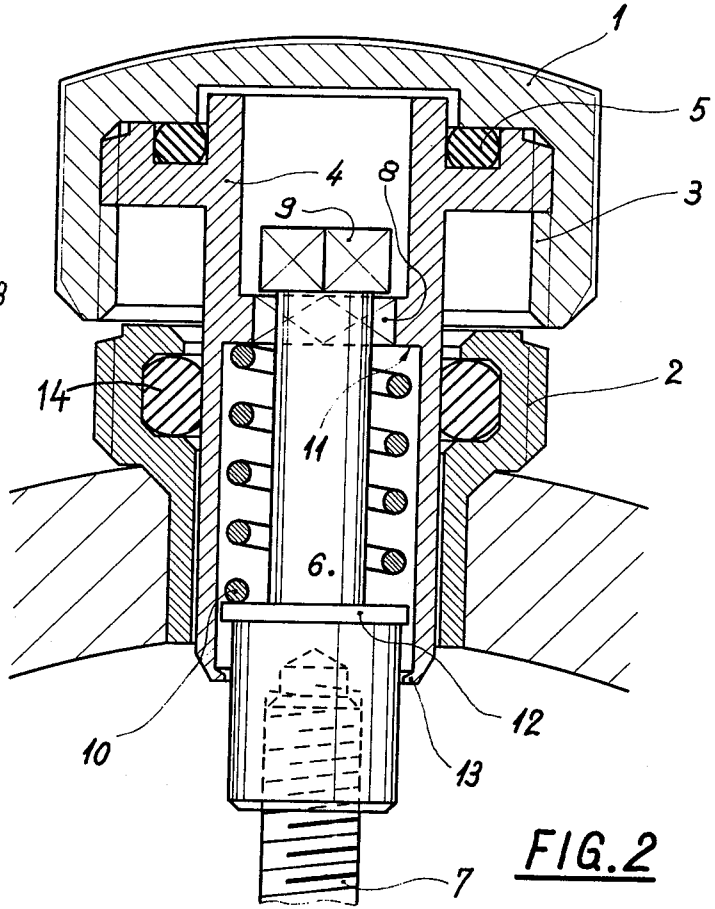

The invention concerns fluid-tight winding button assemblies of the type comprising a button head which can be screwed onto and unscrewed from a pendant tube, the button head carrying a sleeve disposed about a winding-stem shank, and the sleeve and shank having interengageable complementary non-circular parts forming means for coupling the shank for rotation by the button head when the latter is unscrewed from the pendant tube.

An aim of the invention is to obtain a good fluid-tightness between the sleeve and the button head and a good guiding of the sleeve in the pendant tube.

According to the invention, such an assembly is characterized by the fact that the button head has an external skirt with an inner cylindrical surface screw-threaded along its entire length, said sleeve being fully screwed in said skirt in an end part of its thread and the remainder of the thread of said skirt being screwable on the pendant tube, a biasing spring acting between said sleeve and a shoulder on said shank to bias the sleeve and shank towards a coupling position, a first sealing joint being interposed between said sleeve and the button head, and a second sealing joint being interposed between the sleeve and the pendant tube.

Figure 1:
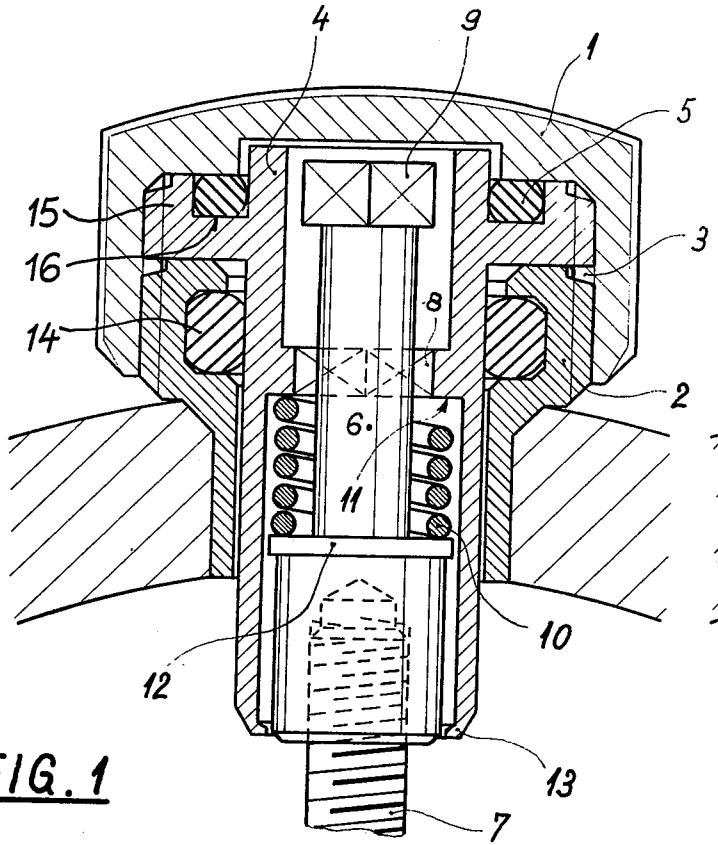

The accompanying drawings show, by way of example, an embodiment of the invention. In the drawings:

FIG. 1 is a cross-section of a winding button assembly with the button screwed in; and FIG. 2 is a similar view with the button unscrewed.

The fluid-tight winding button assembly shown fitted on a watch case in FIGS. 1 and 2 includes a crown or button head 1 which, in an inoperative position, is screwed on a pendant tube 2. The head 1 has an external cylindrical skirt, knurled on its outer surface and having an inner screw thread 3 along it entire inner surface.

On the inner end part of this screw thread 3 a sleeve 4 is screwed by means of an externally threaded flange 15. A sealing joint 5, lodged in an annular groove 16 in the upper face of flange 15, is interposed between the sleeve 4 and button head 1.

The sleeve 4 surrounds a shank 6 to which a windng stem 7 is secured by screwing.

A coupling device formed of a non-circular part 8 of the bore of sleeve 4 and an end part 9 of corresponding complementary shape of the shank 6 enables uncoupling of the sleeve 4 from the shank 6 when the head 1 is screwed on the pendant tube 2 as shown in FIG. 1, and coupling of the sleeve 4 with shank 6 when the head is unscrewed from the pendant tube (see FIG. 2).

A spring 10 bearing on a shoulder 11 of sleeve 4 and on a shoulder 12 of the shank 6 biases these two parts away from one another. The sleeve 4 is held in an extreme position by abutment of shoulder 12 with an inset flange 13 on the lower end of sleeve 4. In this extreme position, obtained after unscrewing the button 1, the coupling parts 8,9 interengage so that the winding stem 7 can be rotated by turning the button head 1.

A sealing joint 14 is interposed between the pendant tube 2 and the cylindrical outer surface of sleeve 4, this joint 14 being lodged in a groove in the relatively large externally threaded part of the pendant tube 2.

Fluid-tightness between the button head 1 and the sleeve 4 is excellent and easily provided, as is that between sleeve 4 and pendant tube 2.

Guiding of the sleeve 4 in the pendant tube 2 is very good, as the cooperating cylindrical surfaces are relatively long.

Positioning of the spring 4 in the lower part of the sleeve 4 enables use of a long spring which is only slightly stressed and can be compressed into a relatively small place when the button head 1 is screwed on the pendant tube 2.

Finally, the hollow crown head is relatively thin and may be manufactured economically by stamping followed by screw-cutting

What is claimed is:

1. A fluid-tight winding button assembly of the type comprising a button head which can be screwed onto and unscrewed from a pendant tube, the button head carrying a sleeve disposed about a winding-stem shank, and the sleeve and shank having interengageable complementary non-circular parts forming means for coupling the shank for rotation by the button head when the latter is unscrewed from the pendant tube, wherein the button head has an external skirt with an inner cylindrical surface screw-threaded along its entire length, said sleeve being fully screwed in said skirt in an end part of its thread and the remainder of the thread of said skirt being screwable on the pendant tube, a biasing spring acting between said sleeve and a shoulder on said shank to bias the sleeve and shank towards a coupling position, a first sealing joint being interposed between said sleeve and the button head, and a second sealing joint being interposed between the sleeve and the pendant tube.

* * * * *